United States Patent [19]

Watanabe et al.

[11] Patent Number: 4,630,772

[45] Date of Patent: Dec. 23, 1986

[54] INSULATING PLATE FOR RAIL INSULATED JOINT

[75] Inventors: Kainen Watanabe, Tokyo; Hiroto Yasuhara, Ayase; Toru Sugiyama, Kunitachi; Keiji Shimizu, Tokyo; Yoshihiro Murata, Katano, all of Japan

[73] Assignees: Matsushita Electric Industrial Co., Ltd., Osaka; Japanese National Railways, Tokyo, both of Japan

[21] Appl. No.: 848,908

[22] Filed: Apr. 4, 1986

Related U.S. Application Data

[63] Continuation of Ser. No. 641,287, Aug. 16, 1984, abandoned.

[30] Foreign Application Priority Data

Aug. 18, 1983 [JP] Japan ..... 58-149663

[51] Int. Cl.[4] ..... F01B 11/00

[52] U.S. Cl. ..... 238/159; 238/1; 264/293; 264/322; 338/208; 219/545

[58] Field of Search ..... 238/159, 1, 7; 104/1 R, 104/279; 219/213, 219, 211, 212, 528, 529, 545; 338/208–210, 213; 264/272.18, 293, 322, 36

[56] References Cited

U.S. PATENT DOCUMENTS

| | | | |
|---|---|---|---|
| 1,124,989 | 1/1915 | Wright | 238/159 |
| 2,433,239 | 12/1949 | Rasero | 219/545 X |
| 3,335,953 | 8/1967 | Hamilton, Jr. | 238/159 |
| 4,051,466 | 9/1977 | Protze | 238/1 X |
| 4,232,822 | 11/1980 | Hahn et al. | 238/7 |
| 4,292,110 | 9/1981 | Marteness | 238/159 X |

*Primary Examiner*—David A. Scherbel
*Assistant Examiner*—Glenn B. Foster
*Attorney, Agent, or Firm*—Wenderoth, Lind & Ponack

[57] ABSTRACT

An improved insulating plate for an insulated rail joint includes a main plate portion made of a thermo-plastic resin, thick portions formed on the main plate portion at its side face contacting a joint plate, and planar heater elements embedded in the thick portions.

6 Claims, 4 Drawing Figures

INSULATING PLATE FOR RAIL INSULATED JOINT

This application is a continuation of now abandoned application Ser. No. 641,287 filed Aug. 16, 1984 now abandoned.

BACKGROUND OF THE INVENTION

1. Field of the Invention

The present invention generally relates to a railway or railroad track and, more particularly, to an improved insulating plate employed for a rail having an insulated joint in order to achieve an electrical insulation of a track circuit.

2. Description of the Prior Art

Conventionally, for rails having insulated joints of the type referred to above, there has been provided the so-called ordinary insulated rail in which insulating plates are disposed between the rail and joint plates. Also, there has been provided a glued insulated rail in which a bonding agent is filled between the rail and the joint plates. The former ordinary insulated rail has such a disadvantage that the insulating plates tend to be quickly deteriorated, thus resulting in an insufficient stability of the track as a whole.

More specifically, in FIG. 1, there is shown a joint portion J of a conventional ordinary insulated rail, with an insulating plate 2 thereof illustrated on an enlarged scale in FIG. 2. In FIG. 1, the rail joint portion J includes the pair of insulating plates 2 each formed with bolt inserting through-holes 3 (FIG. 2), and a corresponding pair of joint plates 4, so that a rail 1 is held, at its opposite sides, between the joint plates 4 through the insulating plates 2 which are clamped together by bolts 5 extended through the holes 3 of the insulating plates 2 and nuts 6 engaged with the bolts 5 so as to constitute the joint portion J.

Each of the insulating plates 2 made of a resin such as polyamide or the like is molded to have a generally U-shaped cross section for close contact with the side face of the rail 1, while each of the joint plates 4 prepared, for example, by forging is poor in the surface finishing accuracy, with its surface not being necessarily in conformity with the corresponding side face of the rail 1, and thus, the joint plates 4 locally contact the insulating plates 2. Since the joint plates 4 and the insulating plates 2 under such a state are forcibly clamped together by the bolts 5 and the nuts 6, strong forces are applied to the locally contacting portions due to loads, impacts, etc. during passage of trains, and consequently, the insulating plates 2 may be damaged in a short period. Moreover, even when the same insulating plates 2 are employed for a plurality of joints J, there is a difference in the degree of deterioration owing to the difference in the manner of contact between the joint plates 4 and the insulating plates 2, resulting in an inconvenience from the viewpoint of maintenance.

SUMMARY OF THE INVENTION

Accordingly, an essential object of the present invention is to provide an improved insulating plate for use in a rail insulated joint, which is superior in resistance against impacts, with sufficient durability, and with a substantial elimination of disadvantages inherent in the conventional insulating plates of this kind.

Another important object of the present invention is to provide an insulating plate of the above described type which is simple in structure, and can be readily incorporated into rail insulated joints for ordinary insulated rails at low cost.

A further object of the present invention is to provide a method of constituting a rail insulated joint incorporated with the insulating plates of the above described type in an efficient manner.

In accomplishing these and other objects, according to one preferred embodiment of the present invention, there is provided an insulating plate for a rail insulated joint, which includes a main plate portion made of a thermo-plastic resin, thick portions formed on said main plate portion at its side face contacting a joint plate, and planar heater elements incorporated in said thick portions.

By the above construction of the present invention, an improved insulating plate for use in a rail insulated joint has been advantageously presented through simple construction at low cost.

BRIEF DESCRIPTION OF THE DRAWINGS

These and other objects and features of the present invention will become apparent from the following description taken in conjunction with the preferred embodiment thereof with reference to the accompanying drawings.

DETAILED DESCRIPTION OF THE PREFERRED EMBODIMENT

Figure 1:
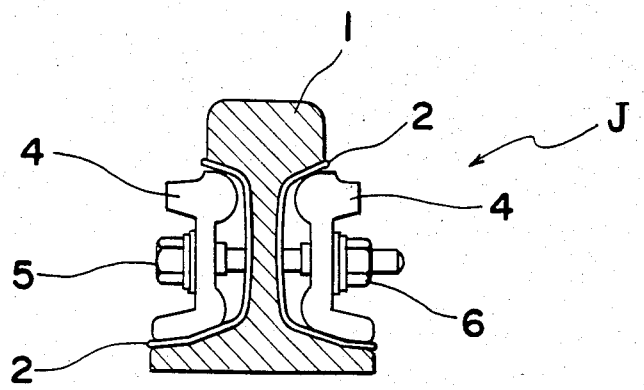
Fig. 1 PRIOR ART
FIG. 1 is a cross sectional view of a conventional rail insulated joint (already referred to)

Before the description of the present invention proceeds, it is to be noted that like parts are designated by like reference numerals throughout the accompanying drawings.

Figure 3:
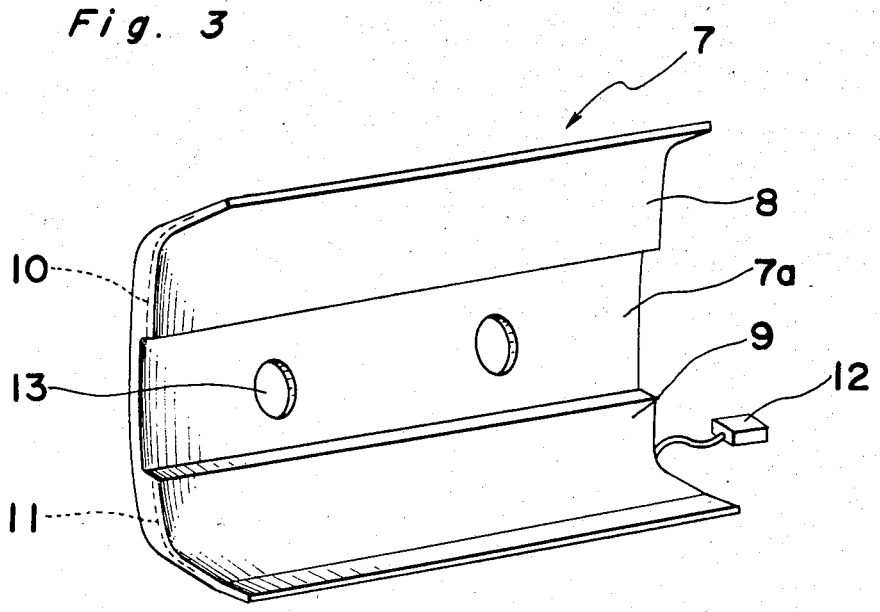
FIG. 3 is a perspective view showing, on an enlarged scale, an improved insulating plate according to one preferred embodiment of the present invention.

Referring now to the drawings, there is shown in FIG. 3 an improved insulating plate 7 according to one preferred embodiment of the present invention. The insulating plate 7 is molded to have a generally U-shaped cross section defined by upper and lower flange connected by a web, from a material in which 10 to 20 parts by weight of glass fibers are mixed into 100 parts by weight of a thermo-plastic resin, for example, polyester elastomer, and is provided, at upper and lower portions on one face of its web or main plate portion 7*a*, with thick portions 8 and 9 which extend through the curved portions and connected upper and lower webs and in which planar heater elements 10 and 11 leading to a plug 12 for connection with an electric power source (not shown) are embedded, with bolt inserting through-holes 13 being formed in the main plate portion 7*a* at positions between the thick portions 8 and 9. Each of the planar heater elements 10 and 11 is of a woven heater prepared by subjecting glass fibers for the warp and annealed copper wires of approximately 0.2 mm in diameter for the weft, to plain weaving at a density of about 20 pieces per 25 mm.

Figure 4:
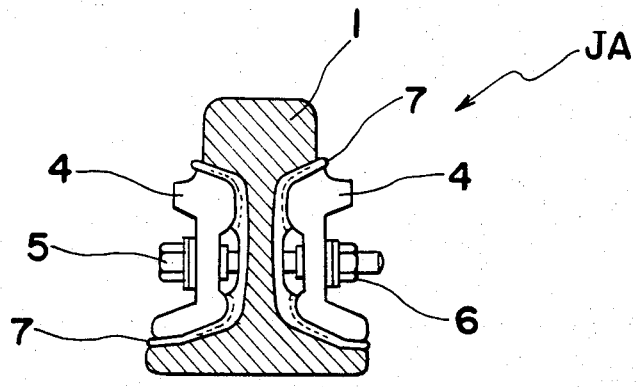
FIG. 4 is a cross sectional view of a rail insulated joint employing the insulating plates of FIG. 3.

As shown in FIG. 4, there is a joint portion JA having the insulating plate 7 as described above. The insulating plates 7 are disposed between the rail 1 and the joint plates 4 so as to be lightly clamped together by the bolts 5 and nuts 6. A commercial power supply at a voltage lower than 100 V is applied to the heater elements 10 and 11 through the plug 12 of FIG. 3. Consequently, the heater elements 10 and 11 are heated, and the resin of the insulating plates 7 in the vicinity of the heater elements 10 and 11 becomes soft after 20 to 30 minutes. In the above state, when the bolts 5 are tightened by a torque of about 2000 kg·cm, the insulating plates 7 are depressed by the joint plates 4 so as to be deformed according to the configuration of said joint plates 4. At this time point, the heater elements 10 and 11 are de-energized, and the insulating plates 7 are clamped together by a predetermined torque after cooling thereof for completion of the assembly.

It should be noted here that, in each of the insulating plates 7 employed in the foregoing embodiment, although the heater elements are embedded along the surface of the plate 7 contacting the joint plate 4, at a depth of about 0.5 mm from said surface, the depth for embedding the heater elements is not limited to that in the embodiment, if the heating time, clamping torque, etc., during the assembling are properly adjusted, and depending on requirements, the heater elements 10 and 11 may be applied on the surface of the insulating plate 7.

Figure 2:
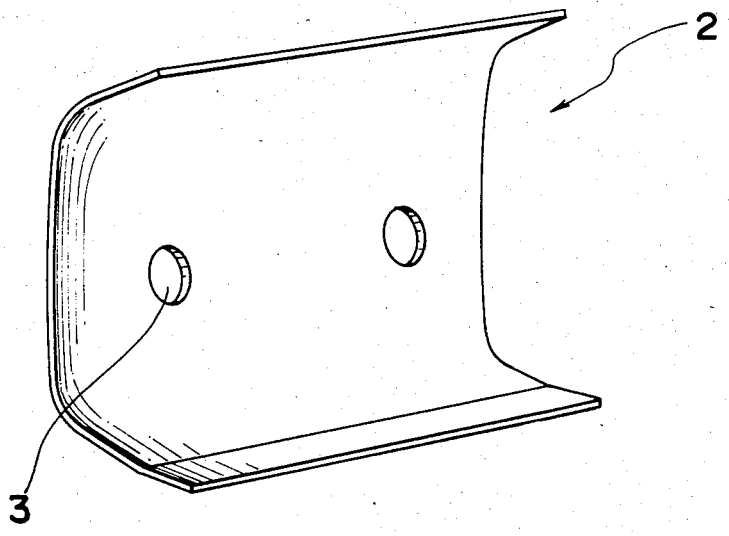
Fig. 2 PRIOR ART
FIG. 2 is a perspective view showing, on an enlarged scale, an insulating plate employed in the rail insulated joint of FIG. 1 (already referred to)

Upon comparison of the conventional rail insulated joint J shown in FIG. 1 and employing the insulating plates 2 of polyamide illustrated in FIG. 2, with the rail insulated joint JA of FIG. 4 according to the present invention employing the improved insulating plates 7 as shown in FIG. 3, in the latter arrangement of FIG. 4, the areas at the contact portions between the insulating plate 7 and the joint plate 4 are increased approximately four times at the upper contact portion and approximately two times at the lower contact portion as compared with those of the conventional arrangement of FIG. 1. Portions with the partial strong contact are observed in the conventional joints. Such portions are not observed in the present invention because there is uniform dispersion of the load received by the insulating plates 7, and thus, the static pressure applied to the insulating plates 7 at the under surface of the rail head portion where damages are most likely to take place, is reduced from 750 kg/cm$^2$ to 150 kg/cm$^2$.

Although the resinous material polyester elastomer employed for the insulating plate 7 of the preferred embodiment has a proper elasticity and is originally strong against pressure impacts, by the reduction of the load per unit area through the increase of the contact face, fatigue and creep, etc. of the resin have been reduced to a large extent, with a marked improvement of durability of the insulating plates 7.

As it is clear from the foregoing description, according to the insulating plate 7 for the rail insulated joint JA of the present invention, in addition to the increase of the contact face with respect to the joint plate 4, since the joint is assembled through heating and clamping, a favorable close adhesion may be achieved among the rail 1, insulating plates 7 and joint plates 4, and slippage, deviation, etc. therebetween do not easily take place. Accordingly, with respect to impacts due to passage of trains, etc., loosening of bolts 5 and the like are difficult to occur, and, because of the durability of the resin material, the life of the insulating plates 7 can be markedly prolonged as compared with the conventional insulating plates 2 of this type.

Although the present invention has been fully described by way of example with reference to the accompanying drawings, it is to be noted here that various changes and modifications will be apparent to those skilled in the art. Therefore, unless otherwise stated that such changes and modifications depart from the scope of the present invention, they should be construed as included therein.

What is claimed is:

1. In an insulating plate for forming an insulated rail joint by positioning said insulated plate between a rail and a joint plate clamped thereto, said insulating plate being of the type having upper and lower flanges connected by a web, whereby said insulating plate is clamped between the rail and the joint plate with the joint plate contacting said upper and lower flanges, the improvement of means for increasing the area of contact of said insulating plate with the joint plate and comprising:

upper and lower portions of said insulating plate being thickened, said thickened portions comprising said upper and lower flanges and respective portions of said web contiguous to said upper and lower flanges;

said insulating plate being formed of a thermoplastic resin material; and means, provided in said thickened portions only of said insulating plate, for heating said thickened portions to soften said thermoplastic resin material to an extent such that clamping of the joint plate enables the softened thermoplastic resin material of said thickened portions to deform to the configuration of the joint plate, whereby the joint plate contacts said insulating plate throughout the area of said thickened portions including said upper and lower flanges and said respective contiguous web portions.

2. The improvement claimed in claim 1, wherein said thermoplastic resin material is prepared by mixing 10 to 20 parts by weight of glass fibers into 100 parts by weight of polyester elastomer.

3. The improvement claimed in claim 1, wherein said heating means in each said thickened portion comprises a woven electric heater prepared by subjecting glass fibers for the warp and copper wires of approximately 0.2 mm in diameter for the weft, to plain weaving at a density of about 20 pieces per 25 mm.

4. The improvement claimed in claim 1, wherein each said heating means is embedded at a depth of about 0.5 mm from the outer surfaces of the respective said thickened portion.

5. The improvement claimed in claim 1, wherein each said heating means is positioned on the outer surface of the respective said thickened portion.

6. In a process for forming an insulated rail joint by clamping insulating plates between a rail and respective joint plates, each said insulating plate being of the type including upper and lower flanges connected by a web, with each said joint plate contacting said upper and lower flanges of the respective said insulating plate, the improvement comprising increasing the area of contact of each said insulating plate with the respective said joint plate by:

forming said insulating plates of a thermoplastic resin material;

providing each said insulating plate with thickened upper and lower portions including said upper and lower flanges and respective portions of said web contiguous to said upper and lower flanges;

providing in said thickened portions only of each said insulating plate respective heater elements;

lightly clamping said insulating plates between said rail and said respective joint plates;

applying electric current to said heater elements and thereby heating said thickened portions to soften said thermoplastic resin material thereof;

increasing the clamping pressure of said joint plates and thereby pressing said joint plates into the softened thermoplastic resin material of said thickened portions throughout the area thereof including said upper and lower flanges and said respective contiguous web portions;

deenergizing said electric current and allowing the thus deformed said thermoplastic resin material to cool; and further increasing the clamping pressure of said joint plates.

* * * * *